United States Patent [19]

Arnoldi et al.

[11] 4,258,373

[45] Mar. 24, 1981

[54] ELECTROSTATIC RECORDING APPARATUS AND METHOD

[75] Inventors: Douglas R. Arnoldi, Southbury; William H. Todd, Jr., Sandy Hook, both of Conn.

[73] Assignee: Burroughs Corporation, Detroit, Mich.

[21] Appl. No.: 78,359

[22] Filed: Sep. 24, 1979

Related U.S. Application Data

[63] Continuation of Ser. No. 12,522, Feb. 15, 1979, abandoned, Continuation of Ser. No. 871,909, Jan. 24, 1978, abandoned.

[51] Int. Cl.[3] ..... G03G 15/04; G06K 15/14

[52] U.S. Cl. ..... 346/154

[58] Field of Search ..... 346/154, 162–163; 358/300

[56] References Cited

U.S. PATENT DOCUMENTS

| | | | |
|---|---|---|---|
| 3,564,556 | 2/1971 | Tsukatani | 346/154 |
| 3,653,065 | 3/1972 | Brown | 346/154 |
| 3,797,021 | 3/1974 | Hida | 346/154 |
| 3,798,609 | 3/1974 | Frohbach | 346/154 X |
| 3,979,760 | 9/1976 | Ta | 346/154 |
| 4,054,885 | 10/1977 | Rothgo rdt | 346/154 |

*Primary Examiner*—John H. Wolff

*Attorney, Agent, or Firm*—Kevin R. Peterson; Robert A. Green; Edward J. Feeney, Jr.

[57] ABSTRACT

The disclosure is of electrostatic recording apparatus including a plurality of groups of printing electrodes on one side of a sheet of printing paper and a plurality of base or counter electrodes on the other side of the paper. Corresponding electrodes in each group of printing electrodes are connected together to form sub-groups of printing electrodes. Data signals, to be printed, are connected to electrodes in all of the sub-groups of printing electrodes at the same time, and selected base electrodes are energized to select the associated printing electrodes which actually perform a printing operaion.

According to the invention, the counter electrodes are operated in pairs, with two adjacent counter electrodes being energized at any instant. However, the counter electrodes are not operated sequentially in pairs, buy they are paired randomly in the series, with favorable spacing being provided between sequentially operated pairs.

8 Claims, 1 Drawing Figure

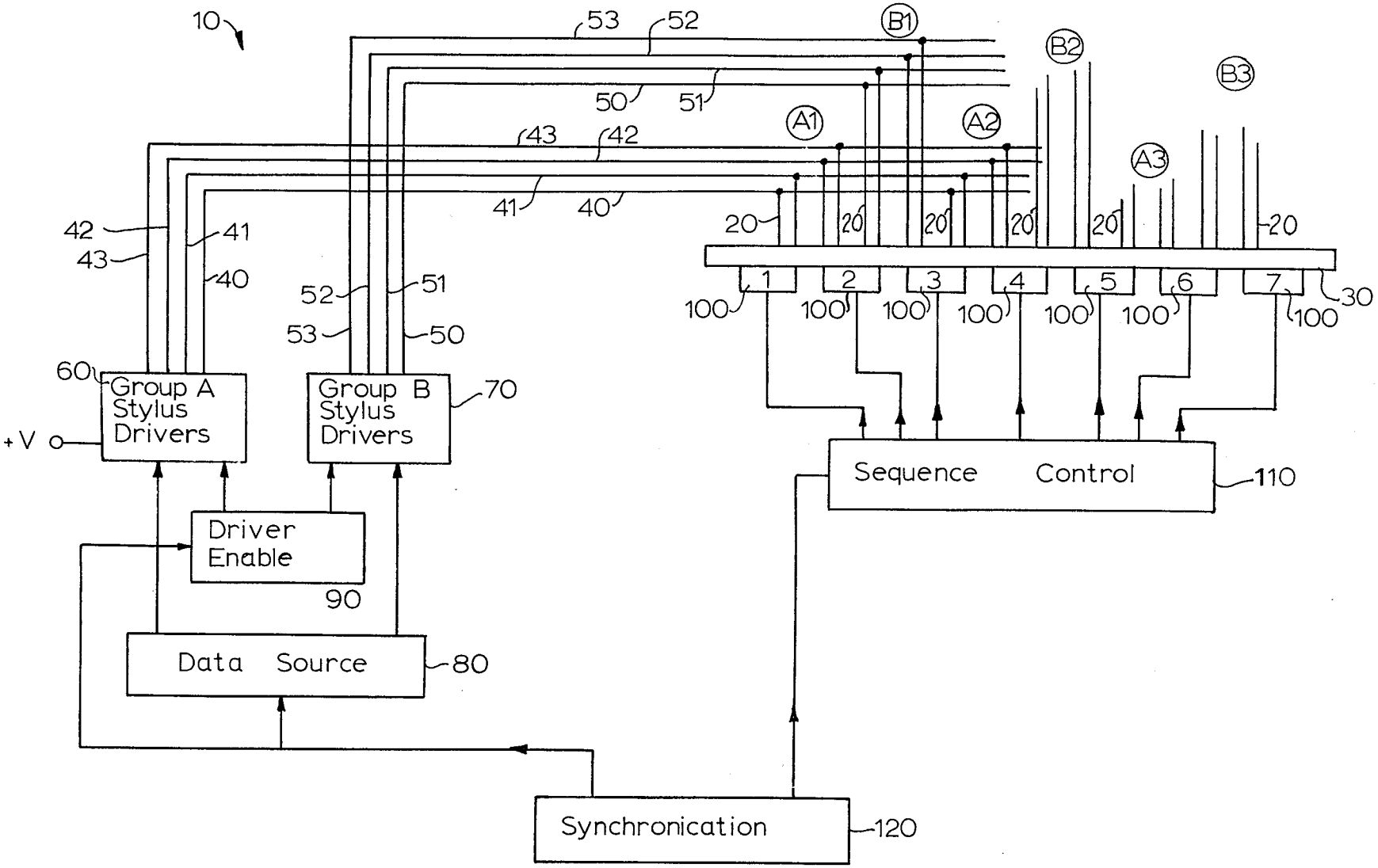
Sequence Control
Synchronication
Group B Stylus Drivers
Group A Stylus Drivers
Driver Enable
Data Source
+V
10
20
30
40
41
42
43
50
51
52
53
60
70
80
90
100
110
120
A1
A2
A3
B1
B2
B3
1
2
3
4
5
6
7

ELECTROSTATIC RECORDING APPARATUS AND METHOD

This is a Continuation of application Ser. No. 12,522, filed Feb. 15, 1979, and now abandoned, filed as a Continuation of Ser. No. 871,909, filed Jan. 24, 1978, now abandoned.

BACKGROUND OF THE INVENTION

The present invention relates to electrostatic printing apparatus including (1) a large number of groups of small diameter printing styli disposed in a series along one side of a sheet of recording paper, and (2) a series of elongated counter electrodes disposed along the opposite surface of the paper. Each counter electrode is aligned with, or is operative with, a plurality of printing styli. Apparatus of this general type has been known in the past, and is shown in many patents such as U.S. Pat. No. 4,054,885. In the prior art, information signals are applied to selected styli in all of the groups simultaneously, and the styli which actually record are selected by the counter electrodes which are energized. Problems have been experienced in achieving quality, high definition printing; and various steps have been taken to cure such problems, and, in one arrangement, the counter electrodes are energized sequentially in pairs, with each pair overlapping groups of printing styli. This method of operation has provided some improvement in printing although the quality and definition of the printing are still not as good as might be desired. This is because charges in the paper build up and exert an adverse effect as the pairs of counter electrodes are energized sequentially.

SUMMARY OF THE INVENTION

According to the invention, improved quality and definition in electrostatic printing with multiple styli is achieved by operating the counter electrodes in pairs, but with the pairs being energized randomly, with selected physical spacing between each pair as it is operated in turn.

DESCRIPTION OF THE DRAWINGS

The drawing is a schematic representation of a portion of a facsimile machine and a system for operating the electrostatic recording electrodes thereof.

DESCRIPTION OF THE PREFERRED EMBODIMENTS

A facsimile system 10 is illustrated schematically in FIG. 1 and includes a relatively large number of wire or pin-like printing or recording styli 20, aligned in a series with their points in contact with one surface of a sheet of paper 30, on which an electrostatic and then a visible message is to be formed, as is well known in the art. The printing electrodes 20 are arranged in groups, and, for circuit economy, they are connected in two groups A and B which alternate with each other. For convenience, only four electrodes 20 are shown in each group, and the groups are denoted as A1, B1, A2, B2, A3, B3 . . . An, Bn.

Corresponding electrodes 20 in the two groups are connected together, and, in the A group, lead 40 connects together the first electrode in each group, lead 41 connects together the second electrode in each group, etc. The electrodes in group B are similarly connected together by leads 50, 51, 52, and 53. For convenience, all of the electrodes 20 are embedded in a suitable insulating carrier, with their recording points accessible at an edge thereof.

The leads 40, 41, 52, 43 are connected to drive circuits, represented by block 60, for applying information signals to one or all print electrodes 20 in group A simultaneously, and the leads 50 are connected to drive circuits, represented by block 70, for similarly applying information signals to the print electrodes in group B. A data sequencing control circuit 80 is coupled to the driver circuits 60 and 70, along with an enabling circuit 90. The data source 80 is coupled to a computer or other suitable source of data and control signals.

Any suitable paper 30 may be used on which electrostatic charges can be formed and then toned to produce a visible message, as is well known in the art.

According to the invention, a series of complementary, counter, or base electrodes 100 are provided in contact with the opposite surface of the paper 30. In FIG. 1, the base electrodes are numbered serially 1 to n. The base electrodes are in alignment with the series of groups of recording styli, with each counter electrode aligned with approximately one-half of one group of recording styli and one-half of the adjacent group of printing styli. In addition, the base electrodes are connected to a sequence control circuit 110 which is designed to energize the base electrodes in pairs, with adjacent electrodes being energized in each pair, but with each pair which is energized being spaced a predetermined distance from the previous pair which had been energized. Thus, for example, each pair of base electrodes which is energized should be separated from the previous pair by at least one base electrode so that, in one sequence, the order of energization of the base electrodes is 1+2, 4+5, 7+8, 2+3, 5+6, 8+9, etc., until all of the printing styli and their base electrodes have been energized. A suitable synchronication circuit 120 is provided to properly synchronize the operation of the recording styli and the base electrodes.

In an actual printing or recording operation, input data signals operate circuitry 80 and drive circuits 60 and 70 to applying printing or recording signals to selected printing electrodes 20 in all groups A and B. At the same time, data signals applied to sequence control circuit 110 energize the first and second base electrodes in the series, with the result that the energized A and B printing electrodes place electrostatic charges on the paper 30. Next, data signals are applied to other selected printing styli, and the fourth and fifth base electrodes are energized to cause the printing styli to print. Next, data signals are applied to still other printing styli, and the seventh and eighth base electrodes are energized; and this operation is continued until all of the styli have been energized and a line of electrostatic dots have been formed on the paper in accordance with the information signals. This operation is repeated line by line until the complete message has been received, printed, and made visible.

Those skilled in the art will appreciate that the invention can be practiced with substantially any number of printing styli. In one practical embodiment, 1728 styli were used. In addition, it is understood that, after the electrostatic image or message has been formed on sheet 30, the message is toned and otherwise processed to render the electrostatic message visible. No attempt has been made to insure dimensional accuracy for the relationship between the recording styli 20 and the base electrodes 100. The proper relationship between these electrodes can be readily determined by those skilled in the art.

What is claimed is:

1. Electrostatic recording apparatus for recording on a record medium having a charge retentive surface, said system comprising a plurality of recording electrodes arrayed in a series in contact with a record medium, circuit means interconnecting like-numbered recording electrodes of separate arrays to establish at least two electrically independent groups of arrays, with each array of each group being separated from every other array of said group by at least one array of the other group, a plurality of complementary electrodes mounted in a series in cooperative relationship with said record medium and aligned with said series of recording electrodes, each complementary electrode being mounted in alignment with and in operative relation with a portion of each of two adjacent groups of recording electrodes, there being first, second, third . . . n complementary electrodes in said series, and means for applying recording signals continuously to selected ones of said recording electrodes and simultaneously applying energizing signals to adjacent pairs of said complementary electrodes in a random sequence along said series, the energization of each pair of complementary electrodes being synchronized with the application of recording signals to said recording electrodes, each pair of energized complementary electrodes being separated by at least one complementary electrode from the previously energized pair of complementary electrodes.

2. The apparatus defined in claim 1 wherein said recording electrodes are small-diameter wire-like electrodes and said complementary electrodes are relatively large-area electrodes.

3. Electrostatic recording apparatus for recording on a record medium having a charge retentive surface, said system comprising a plurality of groups of recording electrodes arrayed in a series in contact with a record medium and adapted to electrically charge areas on the surface of the record medium, circuit means electrically interconnecting corresponding recording electrodes in each said group, a plurality of complementary electrodes mounted in a series in cooperative relationship with said record medium and aligned with said groups of recording electrodes, there being first, second, third . . . nth complementary electrodes in said series, and means for applying recording signals continuously to selected ones of said recording electrodes and simultaneously applying energizing signals to adjacent pairs of said complementary electrodes in a random sequence along said series until all of said complementary electrodes have been energized, the energization of each pair of complementary electrodes being synchronized with the application of recording signals to said recording electrodes, each pair of complementary electrodes which is energized being separated by at least one complementary electrode from the previously energized pair of complementary electrodes.

4. Electrostatic recording apparatus for recording on a record medium having a charge retentive surface, said system comprising a plurality of groups of recording electrodes arrayed in a series in contact with a record medium and adapted to electrically charge areas on the surface of the record medium, each said group including first, second, third . . . nth recording electrodes, a separate lead electrically interconnecting the corresponding recording electrode in each said group, there being one lead interconnecting each first electrode, one lead interconnecting each second electrode, one lead interconnecting each third electrode, etc., a plurality of complementary electrodes mounted in a series in cooperative relationship with said record medium and aligned with said series of groups of recording electrodes, there being first, second, third . . . nth complementary electrodes in said series, and means for applying recording signals continuously to selected ones of said recording electrodes and simultaneously applying energizing signals to adjacent pairs of said complementary electrodes in a random sequence along said series until all of said complementary electrodes have been energized, the energization of each pair of complementary electrodes being synchronized with the application of recording signals to said recording electrodes, each pair of complementary electrodes which is energized being separated by at least one complementary electrode from the previously energized pair of complementary electrodes.

5. The apparatus defined in claim 4 wherein each complementary electrode is positioned in operative relation with a portion of each of two adjacent groups of recording electrodes.

6. The apparatus defined in claim 4 and including data signal input means coupled to said separate leads and thus to said recording electrodes.

7. The apparatus defined in claim 4 wherein said recording electrodes are small-diameter wire-like electrodes and said complementary electrodes are relatively large-area electrodes.

8. Electrostatic recording apparatus for recording on a record medium having a charge retentive surface, said system comprising a plurality of groups of recording electrodes arrayed in a series in contact with a record medium and adapted to electrically charge areas on the surface of the record medium, circuit means electrically interconnecting corresponding recording electrodes in each said group, a plurality of complementary electrodes mounted in a series in cooperative relationship with said record medium and aligned with said groups of recording electrodes, each complementary electrode being mounted in alignment with and in operative relation with a portion of each of two adjacent groups of recording electrodes, there being first, second, third . . . nth complementary electrodes in said series, and means for applying recording signals continuously to selected ones of said recording electrodes and simultaneously applying energizing signals to adjacent pairs of said complementary electrodes in a random sequence along said series until all of said complementary electrodes have been energized, the energization of each pair of complementary electrodes being synchronized with the application of recording signals to said recording electrodes, each pair of complementary electrodes which is energized being separated by at least one complementary electrode from the previously energized pair of complementary electrodes.

* * * * *